US005237280A

United States Patent [19]

Arnold et al.

[11] Patent Number: 5,237,280

[45] Date of Patent: Aug. 17, 1993

[54] APPARATUS FOR MEASUREMENT OF SPARK PLUG IGNITION CURRENT TO MONITOR COMBUSTION

[75] Inventors: Herbert Arnold, Eberdingen; Michael Horbelt, Bietigheim, both of Fed. Rep. of Germany

[73] Assignee: Robert Bosch GmbH, Stuttgart, Fed. Rep. of Germany

[21] Appl. No.: 768,309

[22] PCT Filed: May 15, 1990

[86] PCT No.: PCT/DE90/00354

§ 371 Date: Sep. 26, 1991

§ 102(e) Date: Sep. 26, 1991

[87] PCT Pub. No.: WO90/14705

PCT Pub. Date: Nov. 29, 1990

[30] Foreign Application Priority Data

May 20, 1989 [DE] Fed. Rep. of Germany ..... 3916547

[51] Int. Cl.[5] ..... F02P 17/00; H01T 13/22

[52] U.S. Cl. ..... 324/393; 324/397; 324/402; 313/128; 123/169 R

[58] Field of Search ..... 324/393, 396, 397, 398, 324/402; 313/128, 135, 137, 141, 142; 123/169 R, 169 EL, 425

[56] References Cited

U.S. PATENT DOCUMENTS 2,963,620 12/1960 Knudson .
2,969,500 1/1961 Andert .
3,235,763 2/1966 Candelise et al. ..... 313/128
3,238,447 3/1966 Bychinsky .
3,343,366 9/1967 Siegler .

*Primary Examiner*—Gerard R. Strecker
*Assistant Examiner*—Diep Do
*Attorney, Agent, or Firm*—Michael J. Striker

[57] ABSTRACT

The apparatus for measuring spark plug ignition current to monitor combustion in an internal combustion engine includes a spark plug having a spark plug housing containing a spark plug insulating body (12), a pin-shaped central electrode located in the spark plug housing, a ground electrode held in the spark plug housing insulated from the central electrode so as to cooperate with the central electrode and a current measuring resistor (19) for measuring an ignition current of the spark plug. The ground electrode is grounded by electrical connection to the spark plug housing (10) via the measuring resistor (19). The ignition can be monitored by measuring the ignition current passing through the measuring resistor, since the ignition current must pass directly and entirely through the measuring resistor, and the combustion occurring can be assessed from the measured ignition current. Advantageously the ground electrode is designed as a sleeve, preferably in the form of a grid, in the vicinity of the combustion space end of the sensor.

10 Claims, 4 Drawing Sheets

APPARATUS FOR MEASUREMENT OF SPARK PLUG IGNITION CURRENT TO MONITOR COMBUSTION

BACKGROUND OF THE INVENTION

The present invention relates to a sensor for measurement of ignition current in an internal combustion engine to monitor combustion, especially in the engine of a motor vehicle. Combustion sensors for monitoring combustion in a cylinder of an internal combustion engine are known, which, in part, also function as a spark plug and have a pin-shaped central electrode and a ground electrode.

Spark plugs are known in which knocking in an internal combustion engine is detected by knock sensors and an appropriate evaluation circuit. These knock sensors can, for example, be located in the housing of the spark plug or can be fitted as pressure pick-up rings in the clamping region of the spark plugs. In all these designs, however, the earth electrode of the spark plug is designed as an extension of the housing. These solutions are very complex and expensive. Furthermore, extraneous signals, such as the rattling of valves, are recorded along with the pressure waves and body-borne waves caused by combustion. Evaluation of the ignition current in these solutions is made more difficult by the fact that with threaded spark plugs, the thermal value of the engine block has a negative and not accurately controllable influence on the shape of the measurement curve.

SUMMARY OF THE INVENTION

It is an object of the present invention to provide a combustion sensor for an internal combustion engine which has none of the above-mentioned disadvantages.

This object, and others which will be made more apparent hereinafter, is attained in an apparatus for measuring spark plug ignition current to monitor combustion in an internal combustion engine, comprising a spark plug having a spark plug housing holding two electrodes, the electrodes consisting of a pin-shaped central electrode located in the spark plug housing and a ground electrode held in the spark plug housing insulated from the central electrode so as to be arranged to cooperate with the central electrode.

According to the invention, the apparatus further comprises at least one current measuring means for measuring an ignition current of the spark plug, the ground electrode being connected electrically to the at least one current measuring means, the at least one current measuring means being grounded so that the ground electrode is grounded via the at least one current measuring means and the ignition current flows through the at least one current measuring means.

In contrast, the sensor according to the invention has the advantage that conclusions about the combustion, about misfires during the combustion and damage of various types, e.g. defective spark plug sockets, are possible by measuring the ignition current. It is possible to monitor the ignition and also to assess the quality of the ignition of the mixture and the course of combustion. Because of a grid-type structure of the sleeve which comprises the ground electrode, the sintered insulating body can continue to be manufactured in one operation. The thermal contact between the ground electrode in the screwed-in position can be controlled in a simple manner and determined in accordance with the conditions of the application. Extension of the sleeve into the dead space of the spark plug permits electrical contact underneath the leakage current barrier.

The ground electrode can also include a sleeve portion and at its end closest to a combustion space in the engine block it can have a hook shape and can be bent toward and over the central electrode. The sleeve can also be formed like a grid. The measuring resistor can be connected to either the engine block or the spark plug housing to ground it and the ground electrode connected to it. The measuring resistor can be located in the spark plug socket and its electrical connecting lines can be fed from the housing through the spark plug socket.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
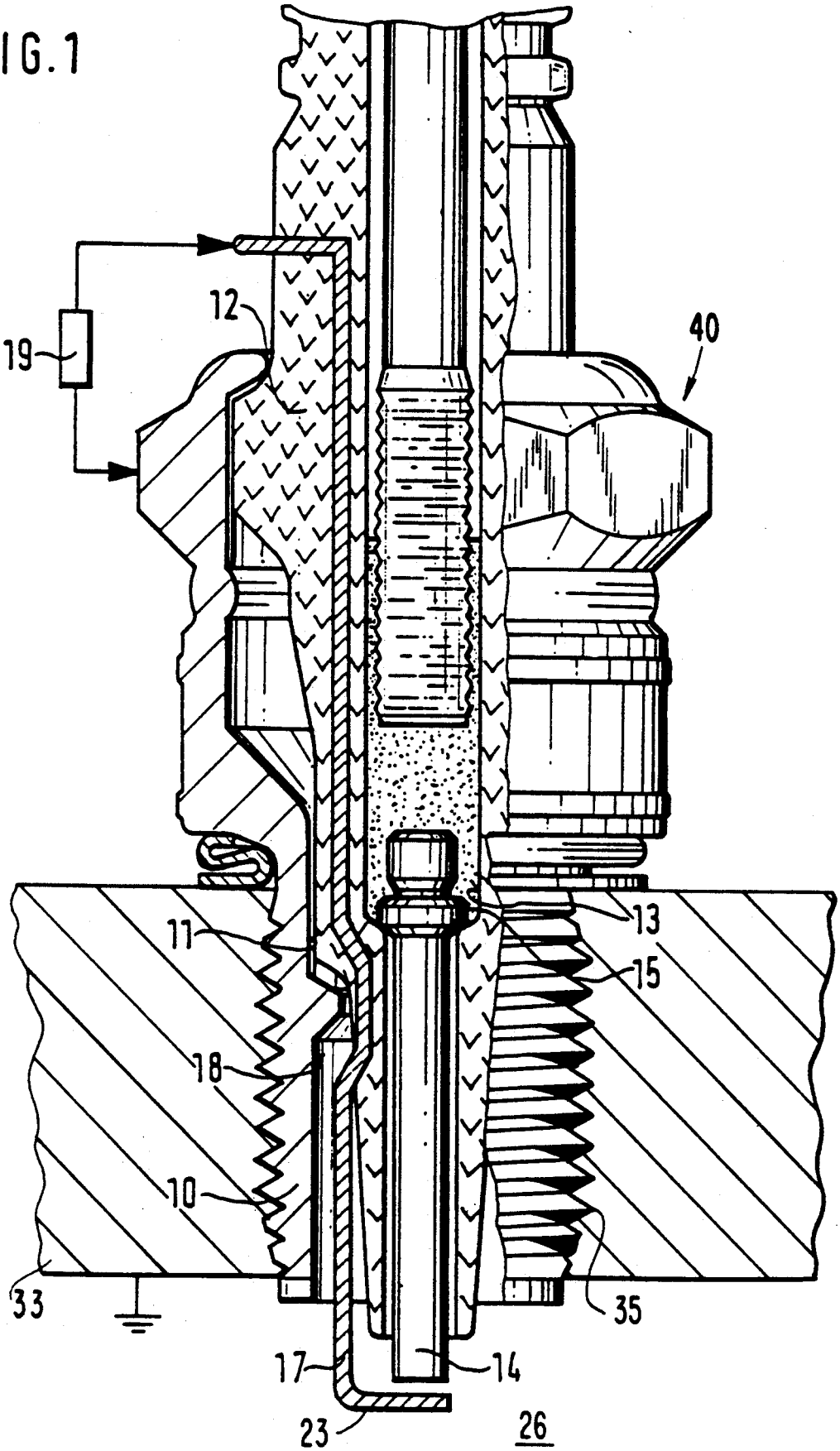
FIG. 1 is a longitudinal cross-sectional view through one embodiment of the combustion space end portion of a sensor for monitoring combustion according to the invention.

One embodiment of a sensor for monitoring combustion in an internal combustion engine is shown in FIG. 1 and includes a spark plug 40 having a spark plug housing 10 holding two electrodes consisting of a central electrode 14 and a ground electrode 17. A spark plug insulating body 12 is coaxial to the longitudinal axis of an approximately central longitudinal hole 11 of the housing and a central electrode 14 is located in a central longitudinal hole 13 of this spark plug insulating body 12. The central electrode 14 contacts a shoulder 15 and has clearance in the region of the longitudinal hole 13. A wire 17 is introduced into the spark plug insulating body 12 as the ground electrode and, in the region of the dead space 18 and outside the threaded portion of the spark plug housing 10, it is bent like a hook electrode around the central electrode 14. The wire 17 is led out of the spark plug insulating body 12 above the threaded portion of the housing 10 and is connected to ground via a measuring element 19. For this purpose, the measuring element 19 can be connected to the metallic material threaded portion of the housing 10.

Figure 2:
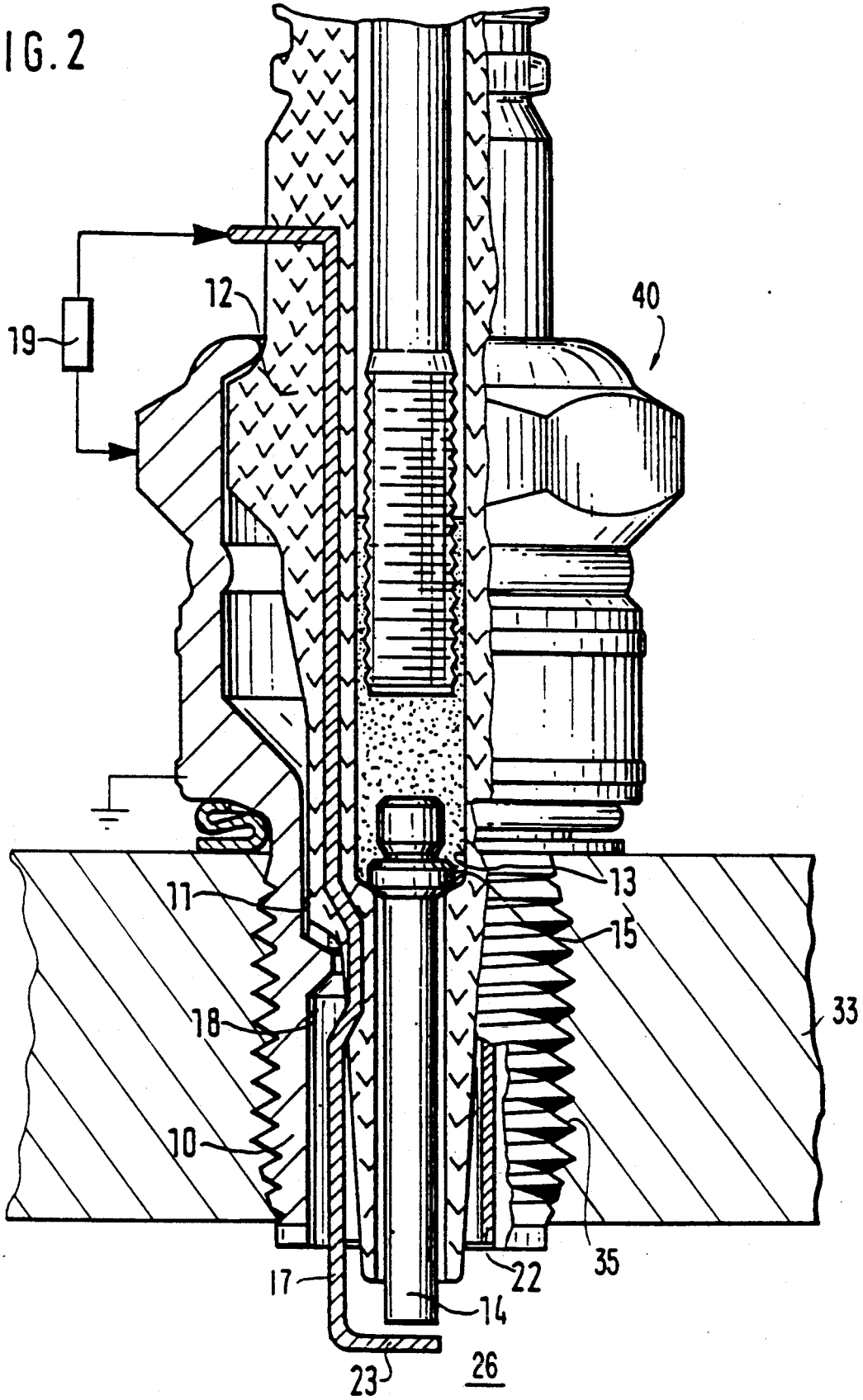
FIGS. 2, 3 and 4 are longitudinal cross-sectional views through other embodiments of the combustion space end portion of a sensor for monitoring combustion according to the invention.

As is shown in the exemplary embodiment of FIG. 2, the ground electrode 14 can also be designed as a sleeve 22. It is also extended into the dead space 18 but only protrudes out of the dead space 18 in the vicinity of an extension 23 acting as a hook electrode or as several hook electrodes into a combustion space 26. By this means, electrical contact is possible below the leakage current barrier.

The measuring resistor 19 in the embodiments of FIGS. 1 and 2 can be grounded through the engine block 33 via the spark plug housing 10, since the spark plug housing 10 is screwed into the threaded hole 35 via its threaded portion.

The spark plug insulating body 12 consists, in conventionally known manner, of sintered material. In order to achieve a homogeneous ceramic structure, the sleeve 22 can be of grid-type design. By this means, the sintered insulating body 12 and the ground electrode can be manufactured in one operation. For this, the sleeve 22 is laid in the sintered body, while the latter is still green, with subsequent sintering. The thermal contact between the ground electrode and the threaded portion of the spark plug housing 10 can be controlled by the thickness of the local region of the spark plug insulating body 12.

Figure 3:
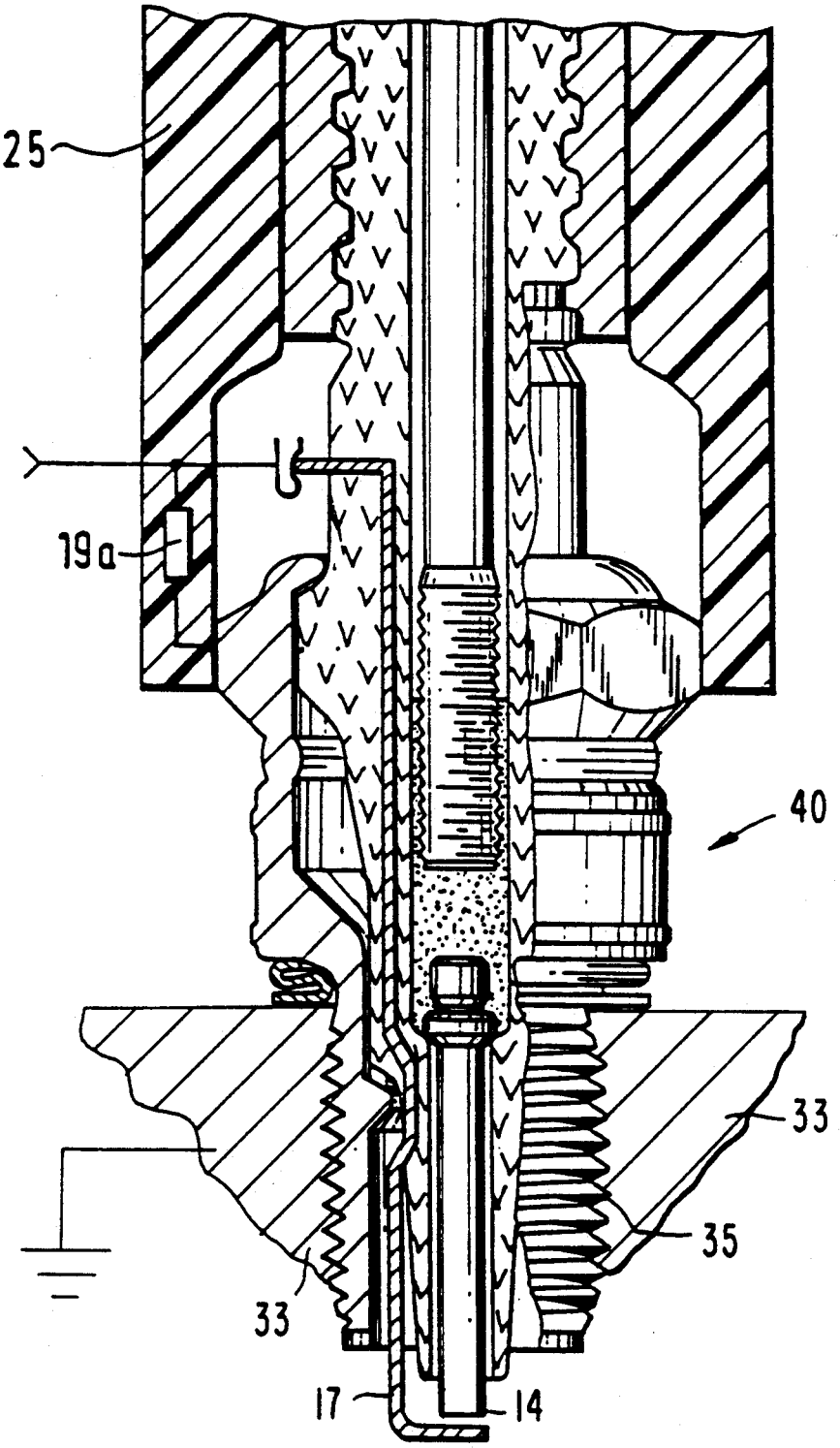
Figure 4:
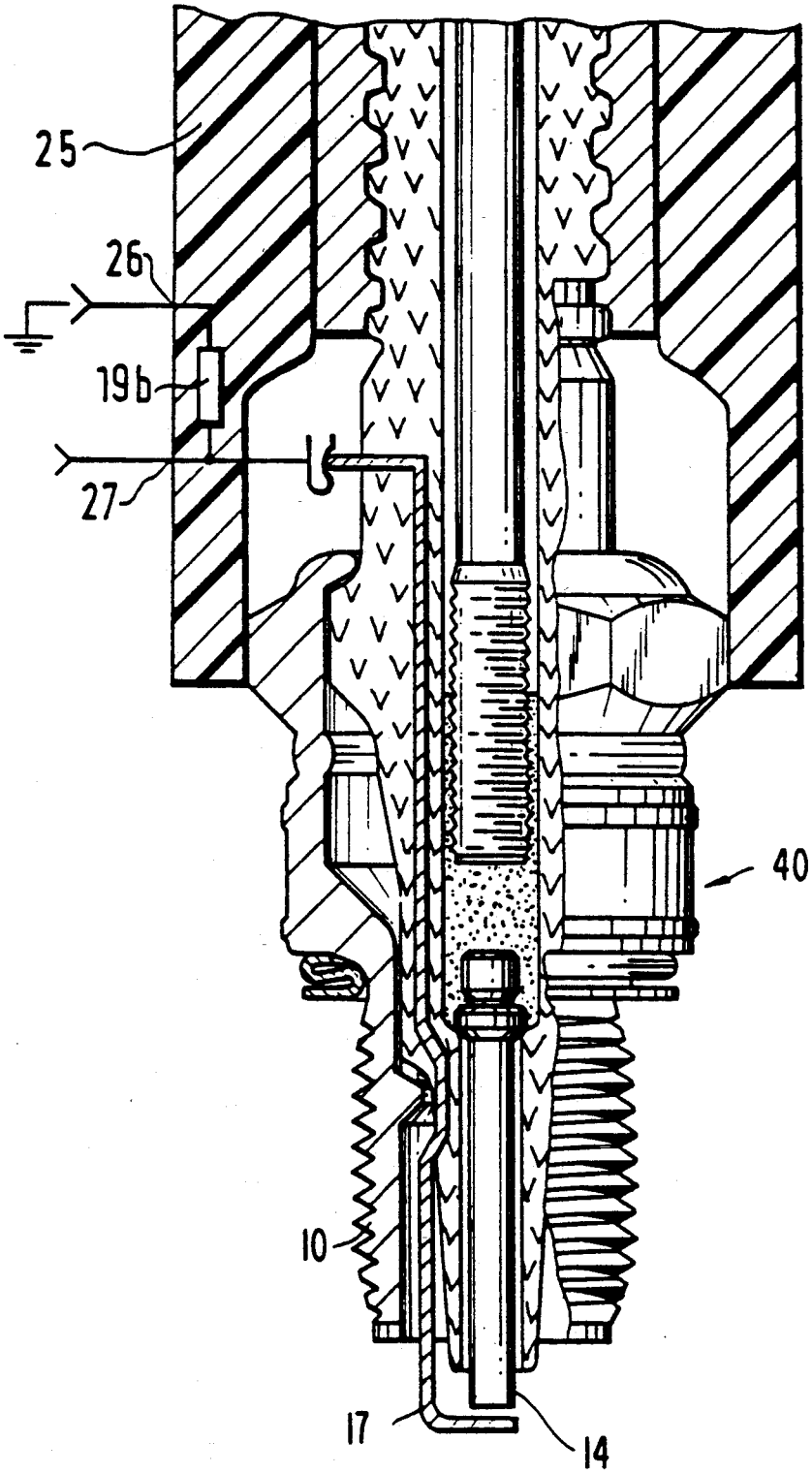

In the embodiment of FIG. 3, the measuring element 19*a*, a resistor, is directly included in the spark plug socket 25. By this means, the measuring resistor 19*a* is automatically grounded when the spark plug socket 25 is put onto the housing, i.e. it is connected either to the spark plug housing or to the engine block. In the embodiment of FIG. 4, the measurement signal is connected to a separate ground. The two electrical connecting lines 26,27 of the resistor 19*b* are led outwards through the spark plug socket 25. The electrical signal can be read off there in the form of a measurement voltage relative to engine ground. Any conventionally known resistance element can be used as the measuring element for determining the voltage. A conclusion about the ignition process is possible from the measurement voltage read off. It is possible to both monitor the ignition and assess the quality of the ignition of the mixture from the variation of the measurement voltage.

While the invention has been illustrated and embodied in an apparatus for measuring spark plug ignition current to monitor combustion, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for measuring spark plug ignition current to monitor combustion in an internal combustion engine, comprising a spark plug having a spark plug housing holding two electrodes, said electrodes consisting of a pin-shaped central electrode located in the spark plug housing and a ground electrode held in the spark plug housing insulated from the central electrode so as to be arranged to cooperate with the central electrode, and at least one current measuring means (19) for measuring an ignition current of the spark plug, the ground electrode being connected electrically to the at least one current measuring means (19), the at least one current measuring means being grounded so that the ground electrode is grounded via the at least one current measuring means and the ignition current flows through the at least one current measuring means.

2. An apparatus as defined in claim 1, wherein the at least one current measuring means (19) comprises a measuring resistor.

3. An apparatus as defined in claim 1, wherein the spark plug has a spark plug insulating body (12) and the ground electrode passes through the spark plug insulating body (12).

4. An apparatus as defined in claim 1, wherein the ground electrode includes a sleeve (22), an end of the ground electrode closest to a combustion space of the internal combustion engine is shaped like a hook electrode bent toward and over the central electrode (14) to cooperate with the central electrode and the sleeve (22) is adjacent the combustion space.

5. An apparatus as defined in claim 4, wherein the sleeve (22) is in the form of a grid.

6. An apparatus as defined in claim 2, wherein the measuring resistor is grounded by electrically connecting the measuring resistor to an engine block of the internal combustion engine.

7. An apparatus as defined in claim 2, wherein the measuring resistor is grounded by electrically connecting the measuring resistor to the spark plug housing (10).

8. An apparatus as defined in claim 2, further comprising a spark plug socket (25), and wherein the measuring resistor is located in the spark plug socket.

9. An apparatus as defined in claim 8, wherein the measuring resistor is provided with electrical connecting lines (26,27) extending out of the spark plug housing (10) and through the spark plug socket (25).

10. An apparatus for measurinq spark plug ignition current to monitor combustion in an internal combustion engine, comprising a spark plug having a spark plug housing containing a spark plug insulating body (12) and two electrodes, said electrodes consisting of a pin-shaped central electrode located in the spark plug housing and a ground electrode held in the spark plug insulating body insulated from the spark plug housing and the central electrode so as to be arranged to cooperate with the central electrode, and a current measuring resistor (19) for measuring an ignition current of the spark plug, the ground electrode being grounded by electrical connection to the spark plug housing (10) via the measuring resistor (19).

* * * * *